US011439210B2

(12) United States Patent
Darby et al.

(10) Patent No.: US 11,439,210 B2
(45) Date of Patent: Sep. 13, 2022

(54) MODULAR LINKING SYSTEM

(71) Applicant: ULTICLIP, LLC, Orlando, FL (US)

(72) Inventors: Randall Lynn Darby, Chicago, IL (US); Clayton Andrew Bass, Bourbonnais, IL (US)

(73) Assignee: ULTICLIP, LLC, Orlando, FL (US)

( * ) Notice: Subject to any disclaimer, the term of this patent is extended or adjusted under 35 U.S.C. 154(b) by 443 days.

(21) Appl. No.: 16/781,426

(22) Filed: Feb. 4, 2020

(65) Prior Publication Data

US 2021/0186165 A1 Jun. 24, 2021

Related U.S. Application Data

(60) Provisional application No. 62/953,291, filed on Dec. 24, 2019.

(51) Int. Cl.

| | |
|---|---|
| ***A44B 19/30*** | (2006.01) |
| ***A45C 13/18*** | (2006.01) |
| ***A44B 19/26*** | (2006.01) |
| ***A44B 19/36*** | (2006.01) |
| ***E05B 65/52*** | (2006.01) |
| *A45C 13/42* | (2006.01) |

(52) U.S. Cl.

CPC ..... *A44B 19/301* (2013.01); *A45C 13/18* (2013.01); *A44B 19/262* (2013.01); *A44B 19/36* (2013.01); *A45C 13/42* (2013.01); *E05B 65/52* (2013.01)

(58) Field of Classification Search

CPC ..... A44B 19/301; A44B 19/262; A44B 19/36; A44B 11/25; A44B 11/2515; A45C 13/18; A45C 13/42; A45C 7/009; E05B 65/52; A47G 1/1613; A47G 1/66; F16M 13/022; Y10T 403/32401

USPC ..... 224/197–200

See application file for complete search history.

(56) References Cited

U.S. PATENT DOCUMENTS

| | | | | | |
|---|---|---|---|---|---|
| 1,408,909 | A * | 3/1922 | Shaff | E05B 65/523 | 70/66 |
| 1,772,854 | A * | 8/1930 | Borresen | E05B 65/52 | 24/658 |
| 2,730,390 | A * | 1/1956 | Atkinson | E05B 65/50 | 70/67 |
| 2,751,241 | A * | 6/1956 | Simonsen | E05B 65/50 | 70/67 |
| 3,529,799 | A * | 9/1970 | Schaefer | A47G 1/0655 | 315/214 |

(Continued)

*Primary Examiner* — Lloyd A Gall

(74) *Attorney, Agent, or Firm* — Innovation Capital Law Group, LLP; Vic Lin

(57) ABSTRACT

A modular linking system allows bags, pouches, and other items to be connected together quickly and securely while providing the ability to remotely disconnect the two items. The modular linking system includes a post assembly and a receiver assembly, each of which includes a geared component to permit variously angled, non-rotational engagement therebetween. The receiver assembly includes a locking member that is resiliently moveable to an unlocked position to permit disengagement between the post assembly and the receiver assembly. The locking member includes two arms that are positioned in a slide lockup channel of the post assembly in the locked configuration, where the arms move out of engagement with the slide lockup channel in the unlocked configuration.

18 Claims, 13 Drawing Sheets

(56) References Cited

U.S. PATENT DOCUMENTS

| | | | | |
|---|---|---|---|---|
| 4,228,666 | A * | 10/1980 | Perez-Alonso | A45C 13/28 70/67 |
| 5,167,355 | A * | 12/1992 | Hill | A45F 5/00 403/97 |
| 6,705,498 | B2 * | 3/2004 | Gantert | B60R 7/14 224/558 |
| 7,162,281 | B2 * | 1/2007 | Kim | B60R 11/0241 455/100 |
| 7,397,915 | B2 * | 7/2008 | Tages | H04B 1/3888 379/454 |
| 7,464,908 | B2 * | 12/2008 | Files | F41B 5/066 248/229.16 |
| 8,087,451 | B2 * | 1/2012 | Gammons | F16L 37/0841 165/46 |
| 8,251,266 | B2 * | 8/2012 | Gregory | F41C 33/045 224/198 |
| 8,985,535 | B1 * | 3/2015 | Townsend, Jr. | F16B 2/00 248/214 |
| 9,944,217 | B2 * | 4/2018 | Schroeder | B60P 7/0815 |
| 10,712,127 | B2 * | 7/2020 | Tedder | B60R 7/14 |
| 10,900,607 | B1 * | 1/2021 | Newman | F16B 2/005 |
| 2004/0079001 | A1 * | 4/2004 | McMullin | A43C 15/161 36/134 |
| 2015/0233669 | A1 * | 8/2015 | Ponder | F41C 33/001 224/271 |
| 2018/0125269 | A1 * | 5/2018 | Smeja | A47G 1/17 |
| 2018/0195834 | A1 | 7/2018 | Tedder et al. | |

* cited by examiner

MODULAR LINKING SYSTEM

CROSS-REFERENCE TO RELATED APPLICATIONS

This application claims the benefit of priority to U.S. provisional patent application No. 62/953,291, filed Dec. 24, 2019, the contents of which are herein incorporated by reference.

BACKGROUND OF THE INVENTION

1. Field of the Invention

Embodiments of the invention relate generally to connectors. More particularly, embodiments of the invention relate to a modular linking system that provides the ability to attach and detach items securely together with ease and quickness. Embodiments of the invention can be used to but not limited to linking bags, containers, backpack, and equipment together, with the ability to quickly detach and exchange items at will.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Carrying equipment and gear has been performed in a variety of ways, including bags, backpacks, pouches. Solutions to increase the modularity of carrying equipment include molle, hook and loop systems, lashing or tying, or sewing together. The problem with the aforementioned solutions is that they do not permit two items to be quickly, easily, and securely attached, detached and interchanged.

In view of the foregoing, there is a need for an improved modular linking system that addresses deficiencies of conventional systems.

SUMMARY OF THE INVENTION

Aspects of the present invention provide a user with the ability to rigidly link two objects together quickly and securely with the ability to position one object to the other with multiple locking angles. Certain embodiments of the invention allow the quick detachment and the ability to exchange the objects being linked together with other items that utilize this attachment system.

Embodiments of the present invention provide a modular locking system comprising a receiver assembly including a base; a cover fitting on one side of the base; a post hole formed in the base, the post hole configured to receive a portion of a post assembly therein; a space formed between the base and cover; and a slide fitting in the space, the slide moveable between a locked position, where a locking surface of the slide interacts to the post assembly to retain the post assembly to the receiver assembly, and an unlocked position, where the locking surface is moved out of interaction with the post assembly, wherein the locking surface has an arc that interacts, along at least a portion thereof, with the post assembly in the locked position.

Embodiments of the present invention further provide a modular locking system comprising a receiver assembly including a base, a cover fitting on one side of the base, a post hole formed in the base, the post hole having a plurality of female teeth defining an exterior surface of the post hole, a space formed between the base and cover, and a slide fitting in the space, the slide moveable between a locked position, where a locking surface of the slide interacts to the post assembly to retain the post assembly to the receiver assembly, and an unlocked position, where the locking surface is moved out of interaction with the post assembly, wherein the locking surface has an arc that interacts, along at least a portion thereof, with the post assembly in the locked position. The modular locking system further comprising a post assembly including a gear having a plurality of teeth aligning with the plurality of female teeth of the post hole of the base, and a lockup channel formed between the gear and a distal side of the post assembly, the base of lockup channel aligning with the arc of the locking surface, wherein the cover includes a cover post hole aligning with the post hole of the base, the cover post hole formed without teeth therein.

Embodiments of the present invention also provide a modular locking system comprising a receiver assembly including a base, a cover fitting on one side of the base, a post hole formed in the base, the post hole having a plurality of female teeth defining an exterior surface of the post hole, a space formed between the base and cover, and a slide fitting in the space, the slide moveable between a locked position, where a locking surface of the slide interacts to the post assembly to retain the post assembly to the receiver assembly, and an unlocked position, where the locking surface is moved out of interaction with the post assembly. The modular locking system further comprises a post assembly including a gear having a plurality of teeth aligning with the plurality of female teeth of the post hole of the base, a lockup channel formed between the gear and a distal side of the post assembly, the base of lockup channel aligning with the arc of the locking surface, a central hole through the gear, a back member disposed on a proximal side of the gear, the back member having a back member central hole aligning with the central hole of the gear, an extension extending from the distal side of the gear, the extension extending a length of the central hole by a predetermined length, the extension defining the base of the lockup channel, the predetermined length defining a width of the lockup channel, a nut disposed adjacent the extension, and a screw inserted through the back member central hole and the central hole of the gear to mate with the nut, the lockup channel defined between the gear and the nut. The modular locking system further comprises a spring configured to retain the slide in the locked position, the spring resiliently deformable to permit movement of the slide to the unlocked position, the spring disposed in a spring retention channel of the base while interacting with a spring interface of the slide, wherein the cover includes a cover post hole aligning with the post hole of the base, the cover post hole formed without teeth therein.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
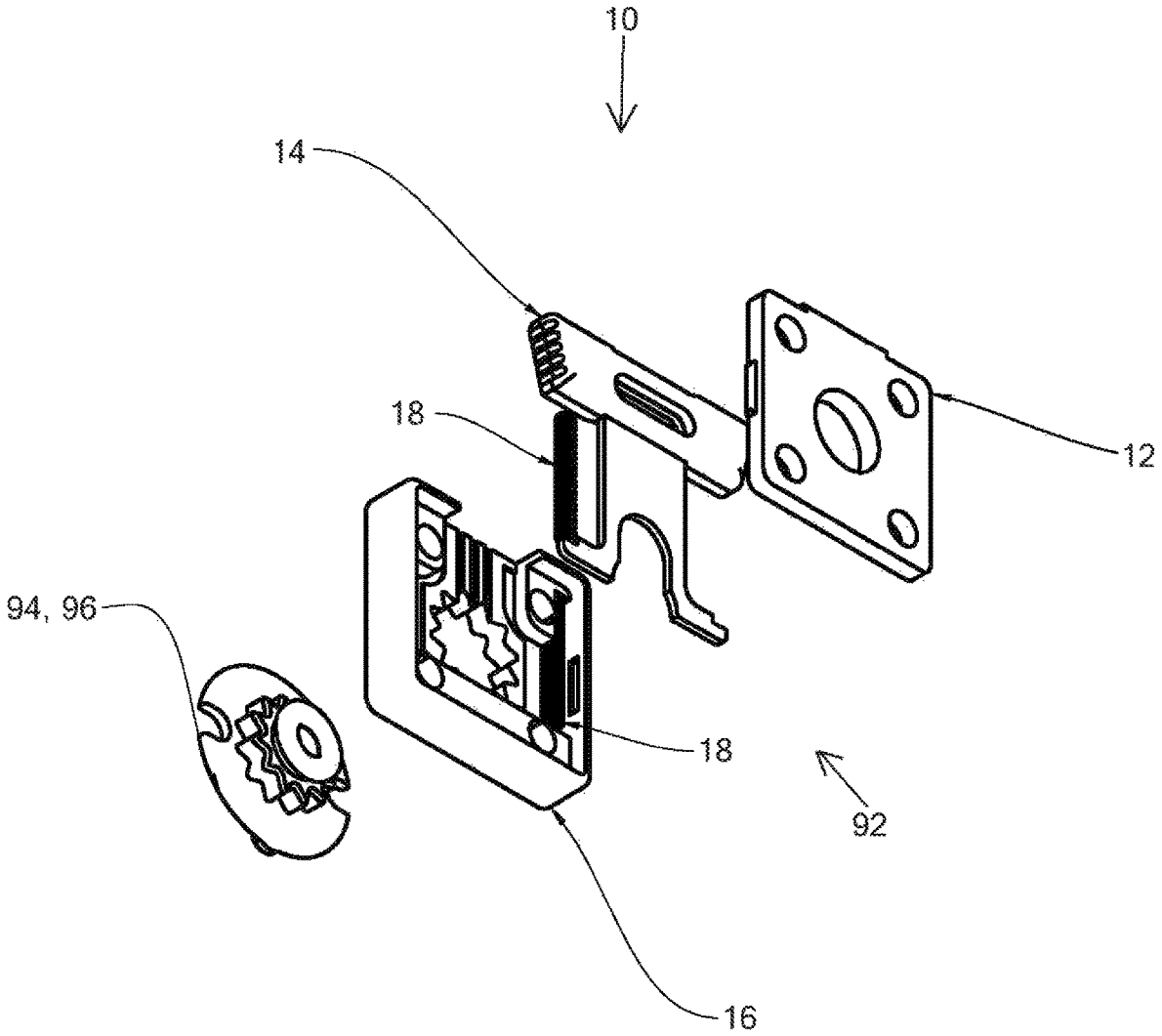
FIG. 1 illustrates an exploded perspective view of a modular linking system, showing the base, slide, springs, cover and post, according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any apparatus, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a modular linking system that allows bags, pouches, and other items to be connected together quickly and securely while providing the ability to remotely disconnect the two items. The modular linking system includes a post assembly and a receiver assembly, each of which includes a geared component to permit variously angled, non-rotational engagement therebetween. The receiver assembly includes a locking member that is resiliently moveable to an unlocked position to permit disengagement between the post assembly and the receiver assembly. The locking member includes two arms that are positioned in a slide lockup channel of the post assembly in the locked configuration, where the arms move out of engagement with the slide lockup channel in the unlocked configuration.

The modular linking system can be broken out into five major different components—the base, springs, the slide or lock, the cover, and the post. The base, slide, springs, and cover can be assembled to form one unit which will be called the receiver assembly. The post can be attached and detached from the receiver assembly as desired.

Typically, the base, post, and cover of the modular linking system would be constructed out of metal or plastic, the springs out of metal and the slide out of metal and/or plastic. Each component listed would be formed out of the desired material and assembled as described below.

Figure 2:
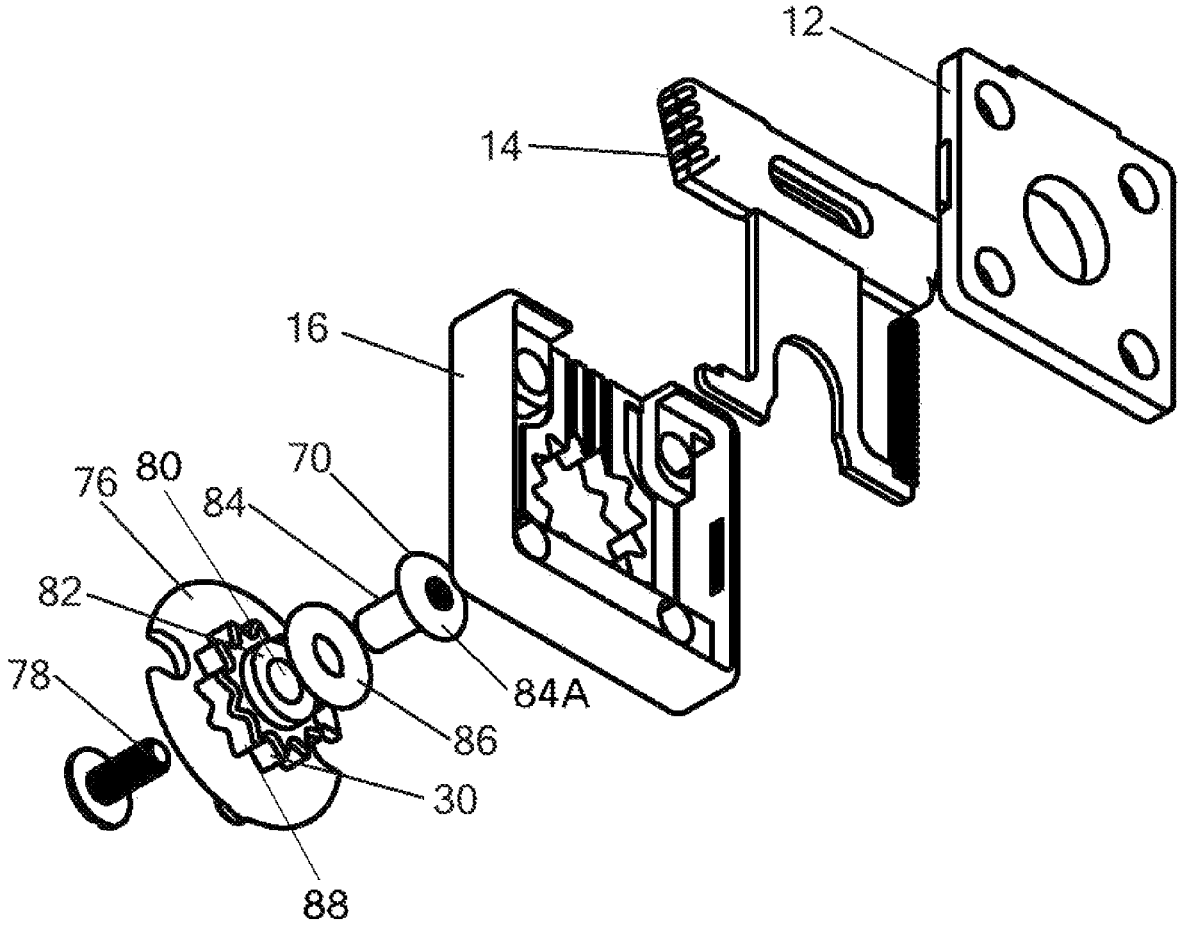
FIG. 2 illustrates another exploded perspective view of a modular linking system, illustrating the post assembly formed from a flanged rivet nut, washer and screw, according to an exemplary embodiment of the present invention.

Referring to FIGS. 1 and 2, a modular linking system 10 can include a receiver assembly 92 and a post assembly 94, 96. The receiver assembly 92 can include a base 16, a slide 14 at least partially moveable along the base, springs 18 resiliently maintaining the slide 14 in a locked position, as described below, and a cover 12. The spring 18 on the left side of the image depicts how the spring 18 interfaces with the slide 14, and the spring 18 on the right side of the image shows where the spring 18 resides in the base 16. Each receiver assembly 92 can utilize two springs 18.

Figure 12:
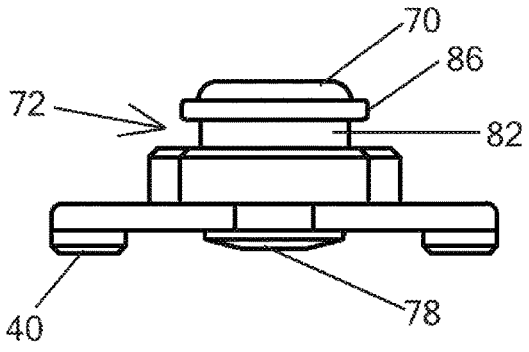
FIG. 12 illustrates a side view of the post assembly of FIG. 10.

The post assembly 94, 96 can include a flanged end 70 having a lockup channel 38, 72 (see FIGS. 9B and 12, for example) formed thereunder with a gear 30 adjacent the lockup channel 38, 72, opposite the flanged end 70. A back member 34, 76 can be formed adjacent the gear 30, opposite the lockup channel 38, 72.

In some embodiments, as shown in FIG. 2, the post assembly 94 96 94 can be formed from a screw 78 insertable through a central hole 80 in the back member 76 and the gear 30. The gear 30 can include an extension 82 that has a diameter smaller than the gear teeth 88. The extension 82 defines the width of the lockup channel 38, 72 (see FIGS. 9B and 12, for example) and defines a base of the lockup channel 38, 72 when the post assembly 94, 96 is assembled. The screw 78 can engage with a flanged rivet nut 84 and a washer 86 can be disposed between the flanged end 84A of the flanged rivet nut 84 and the extension 82, where the lockup channel 72 is formed between the washer 86 and the gear teeth 88 (see FIGS. 10-16). In some embodiments, the washer 86 may not be utilized and the lockup channel 38 may be formed between the flanged end 84A of the flanged rivet nut 84 and the gear 30 (see FIGS. 9A and 9B).

Figure 3A:
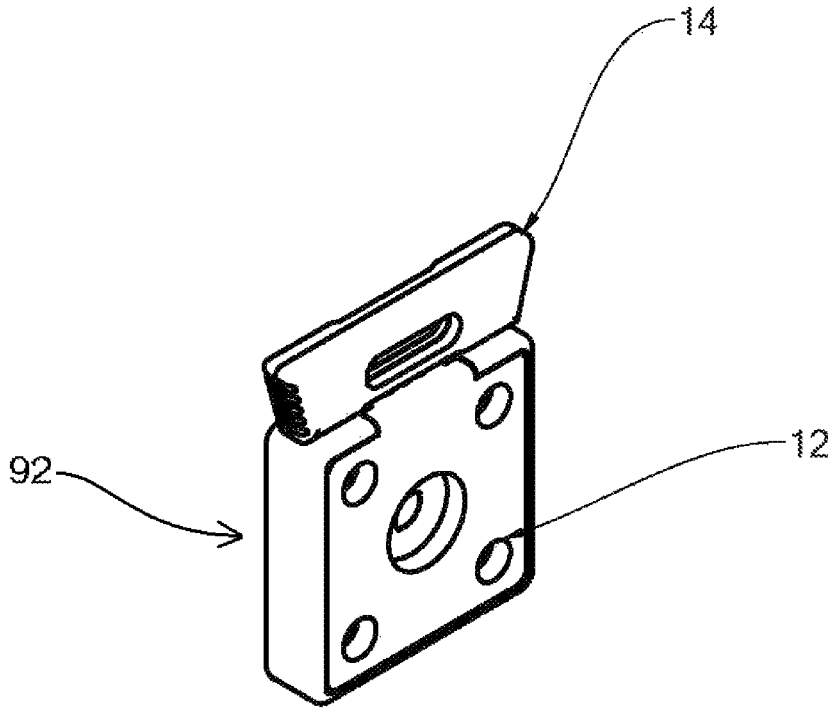
FIG. 3A illustrates rear perspective view of the modular linking system of FIG. 1 with the receiver assembly and the post assembly linked together and the slide in a locked position.
Figure 3B:
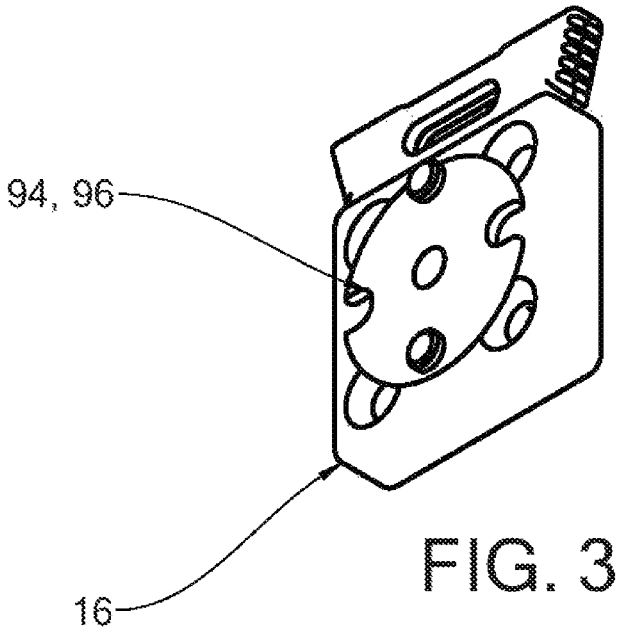
FIG. 3B illustrates front perspective view of the modular linking system of FIG. 1 with the receiver assembly and the post assembly linked together and the slide in a locked position.

FIGS. 3A and 3B illustrate the post assembly 94, 96 disposed on the receiver assembly 92 with the slide 14 in a locked configuration. The base 16 and the cover 12 of the receiver assembly 92 sandwich the slide 14 therebetween. The base 16 and cover 12 may attach together in various manners, including a snap connect, a friction fit, a glued (or otherwise integrally connected) assembly, or the like. To disconnect the post assembly 94, 96 from the receiver assembly 92, the user can lift the slide 14 against the action of the springs 18 (see FIG. 1, for example), which would be compression springs in this embodiment, to cause the slide 14 to be removed from the lockup channel 38, 72 (see FIGS. 9B and 12, for example), as discussed in greater detail below.

Figure 4:
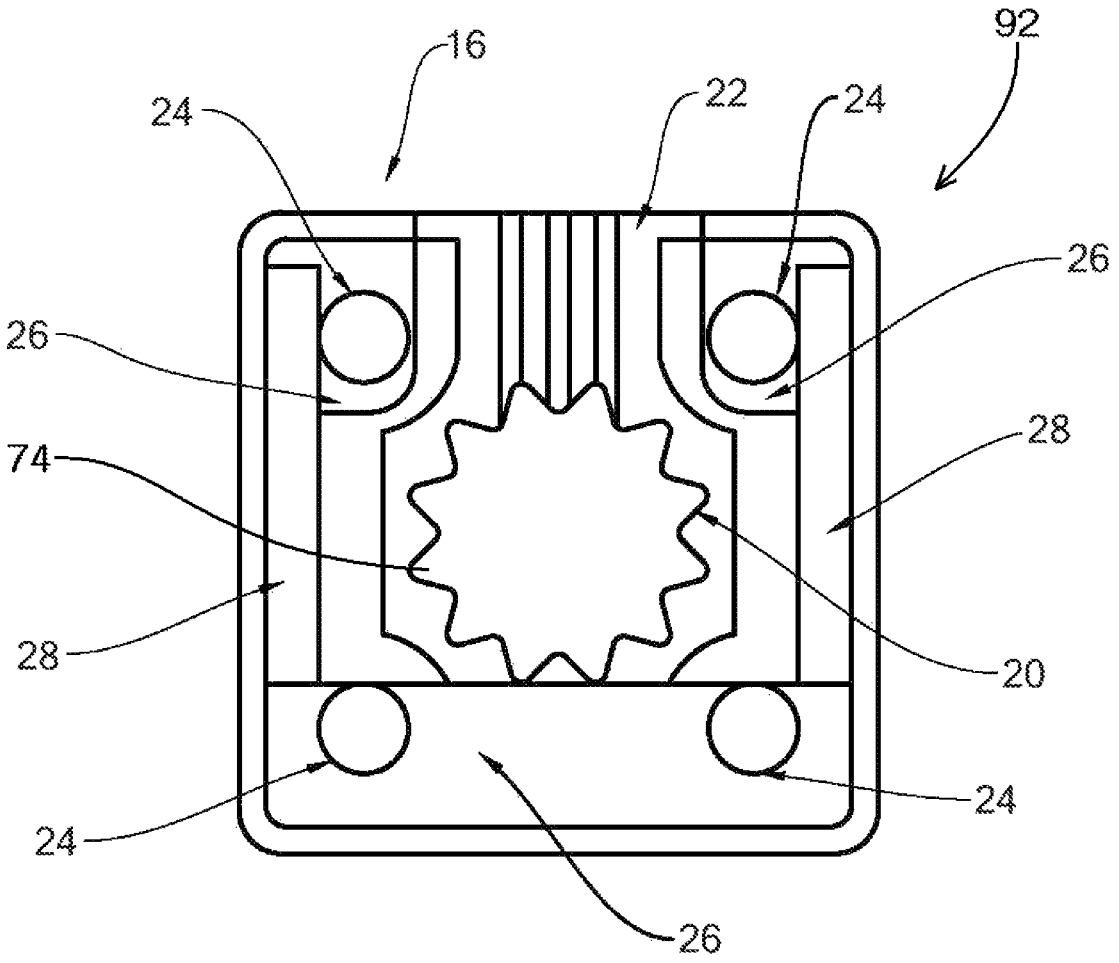
FIG. 4 illustrates a front view of the base of the modular linking system of FIG. 1, showing the gear receiver, slide retention channel, base mounting holes, cover blocking and spring retention channel.

Referring to FIG. 4, the base 16 of the receiver assembly 92 is shown. The slide 14 can reside in a slide retention channel 22. The slide retention channel 22 can prevent the slide 14 from any side-to-side motion. The slide 14 can protrude out of the base 16 by way of the slide retention channel 22. This is shown in the assembled drawing in FIGS. 3A and 3B. There are four base mounting holes 24 whose purpose is to affix the receiver assembly 92 to any desired object. Screws, cable ties, wire or other similar mounting hardware can be passed through the mounting holes 24 in order to affix the receiver assembly 92 to another item. For example, a bag, backpack, wood, plastic or tubing could be affixed in this manner. Cover blocking 26 around the mounting holes 24 can maintain the desired distance between the slide 14 and the cover 12 so that when the cover 12 is assembled with the base 16, sliding motion of the slide 14 is not inhibited. Two spring retention channels 28 can maintain the position of the two springs 18 as they interface with the slide 14.

Figure 5A:
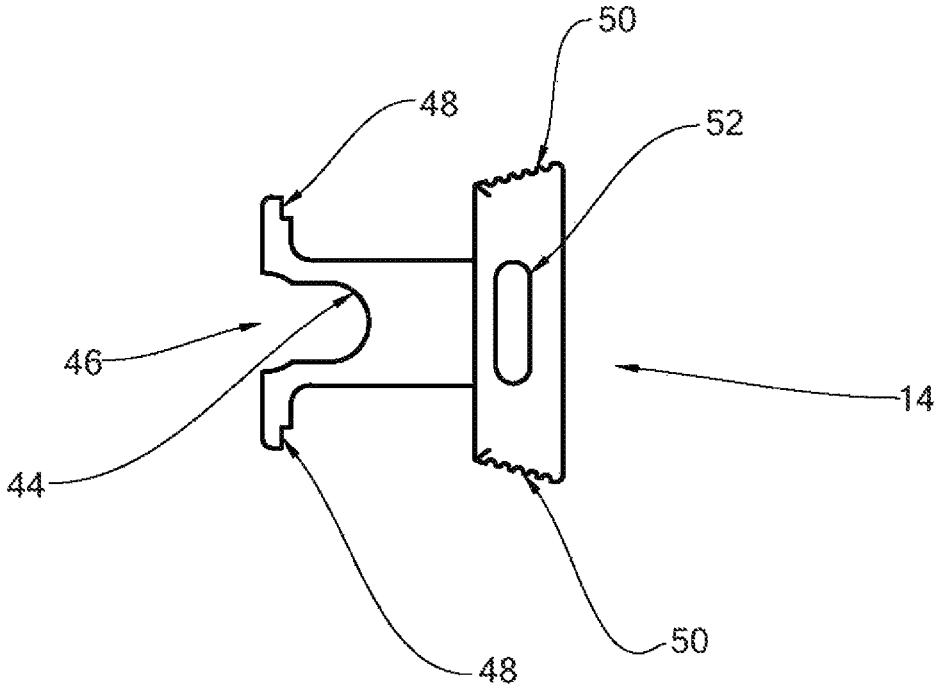
FIG. 5A illustrates a front view of the slide of the modular linking system of FIG. 1, showing the locking area, release area, spring interface, slide grip and lanyard hole.
Figure 5B:
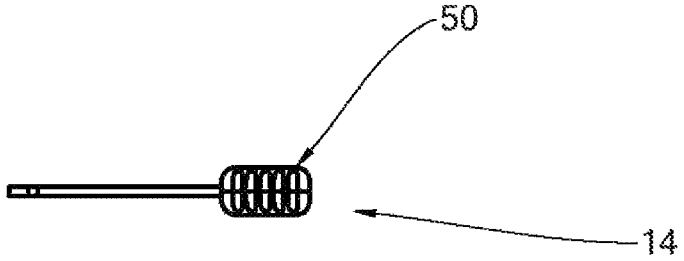
FIG. 5B illustrates a side view of the slide of FIG. 5A.
Figure 7:
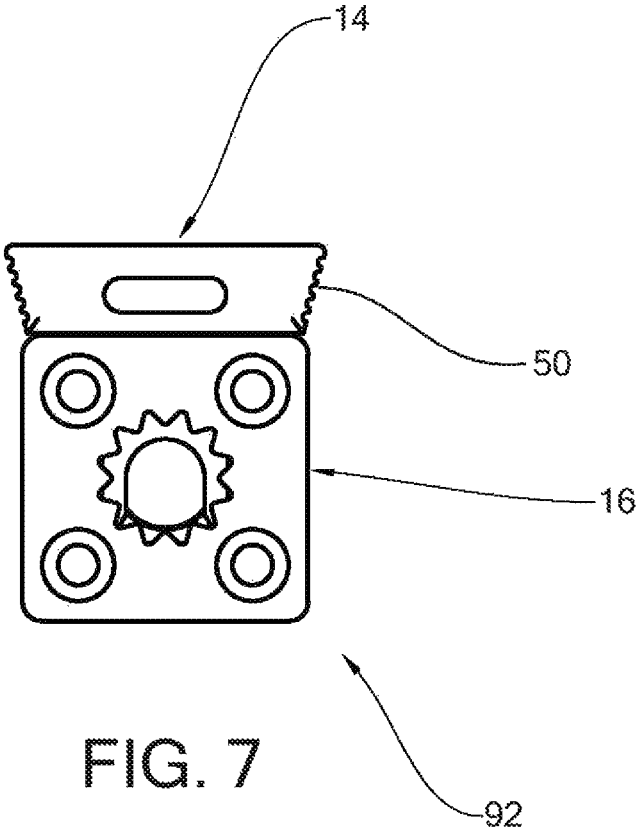
FIG. 7 illustrates a front view of the assembled modular linking system of FIG. 1, in a locked position.

The slide 14 is shown in FIGS. 5A and 5B. The slide 14 can move in a linear motion (linear with respect to its flat, planar surface) while in the slide retention channel 28 of the base 16. The locking area 44 and release area 46 and can be seen in the front view of FIG. 5A. These two areas interact with the post assembly 94, 96, specifically the slide lock up channel 38, 72. As an be appreciated, the locking area 44 may include an arc that is shaped similarly to the arc forming the exterior of the locking channel 38, 72. Thus, the slide 14 can interact with the lockup channel 72 along an interior surface of the slide 14 (the locking area 44). Thus, the locking area 44 surface fitting within the lockup channel 38, 72 may be an arc surface extending a predetermined arc length. Thus, instead of simply a point contact formed from a leg extending tangentially through the locking area, an arc-shaped locking area can help secure the post assembly 94, 96 and the receiver assembly 92. In some embodiments, the locking surface has an arc wherein at least 90 degrees of the arc interacts with the post assembly in the locked position. As used herein, fitting within the lockup channel 38, 72 can be defined as the region between the gear 30 and the washer 86, for example. The slide 14 is in its natural state with the springs 18 maintaining it in the locked position as they interface on the spring interface 48. The slide 14 in its natural (locked) state can be seen in FIG. 7.

Figure 8:
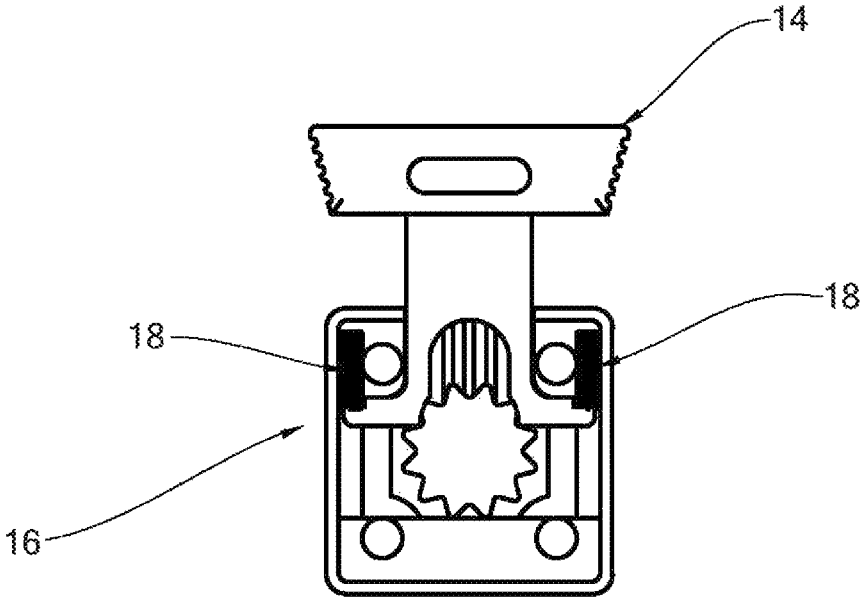
FIG. 8 illustrates a front view of the receiver assembly of the modular linking system of FIG. 1, with the cover removed with the slide in the unlock position with compressed springs.

In FIG. 8, the slide 14 can be seen in the unlocked state in the base 16, where the cover 12 is removed for clarity. The springs 18 can also be seen compressed in the spring retention channels 28 while interacting with the spring interface 48. The slide grip 50 can be seen in FIG. 7 which allows the user to articulate the slide from its natural (locked) state to the unlocked state. While the slide is in the unlock state, the post assembly 94, 96 can be introduced or removed from the receiver assembly 92. The release area 46 of the slide 14 lines up with the slide lockup channel 38 of the post assembly 94, 96. Once the slide is released from the unlocked state, the springs 18 return the slide 14 to its natural (locked) state, which if the post assembly 94, 96 is interfaced with the receiver assembly 92, the locking area 44 of the slide 14 enters the slide lockup channel 38, causing the post assembly 94, 96 to be affixed to the receiver assembly 92 at any desired angle, depending on how the gear teeth 88 of the gear 30 are aligned with the gear receiver 20 of the receiver assembly 92. The gear 30 can interface with the gear receiver 20, which allows the post assembly 94, 96 to be rotated 360 degrees before interfacing the gear receiver 20 at which time the gear 30 and the gear receiver 20 prohibit the post assembly 94, 96 from rotating relative to the base 16. The gear 30 and gear receiver 20 allow anything that is affixed to the receiver assembly 92 to be positioned with 360 degrees of freedom before the two components are interfaced. In addition, if two post assemblies 94, 96 are affixed back to back, they can be used to link two receiver assemblies 92 together. The lanyard hole 52 allows for a string, rope or other flexible cable to be passed therethrough. When the string is pulled it can move the slide 14 to the unlocked position, thus allowing the post assembly 94, 96, and whatever is attached to it, to be released remotely. Two or more receiver assemblies 92 can be simultaneously unlatched from the same number of post assembly 94, 96 by affixing string, rope or other flexible cable in series and/or parallel with the lanyard holes 52 of the number desired receiver assemblies 92 and, when pulled, allowing the same number of post assemblies 94, 96 to be released or affixed to the receiver assemblies 92 at the same time.

Figure 6:
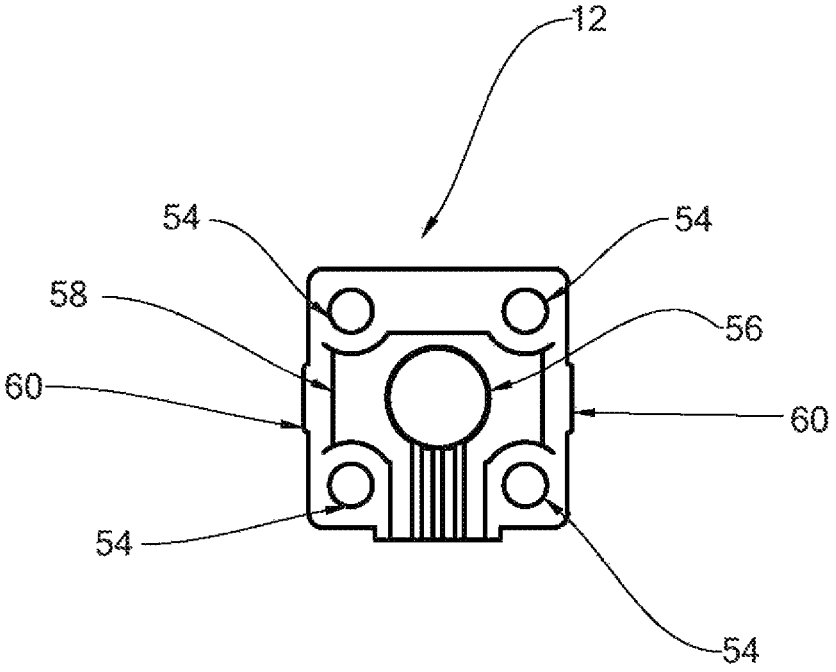
FIG. 6 illustrates a front view of the cover of the modular linking system of FIG. 1, showing the cover mounting holes, post hole, slide blocking and cover retention tabs.

In FIG. 6, the cover 12 is depicted. The cover mounting holes 54 match with the base mounting holes 24 when the two components are assembled. The slide blocking 58 provide additional movement limitation to the slide 14 as it resides in the slide retention channel 22. The post hole 56 allows the head of the post assembly 94, 96 to pass through the cover 12 and provides additional support to the post assembly 94, 96 when it is interfaced with the base 16. The cover retention tabs 60 snap into the base 16 when the cover 12 is assembled with the base 16.

Figure 9A:
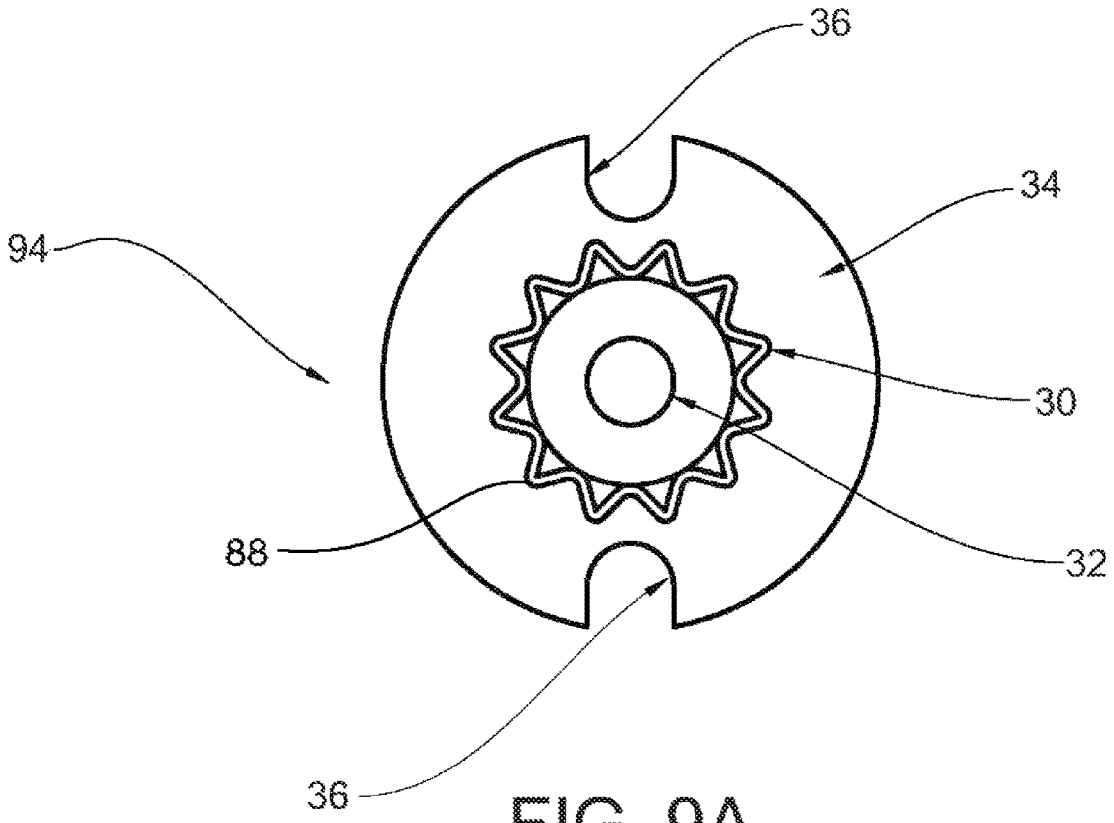
FIG. 9A illustrates a front view of the post of the modular linking system of FIG. 1, showing the gear, post mounting hole, post base and locking slot.
Figure 9B:
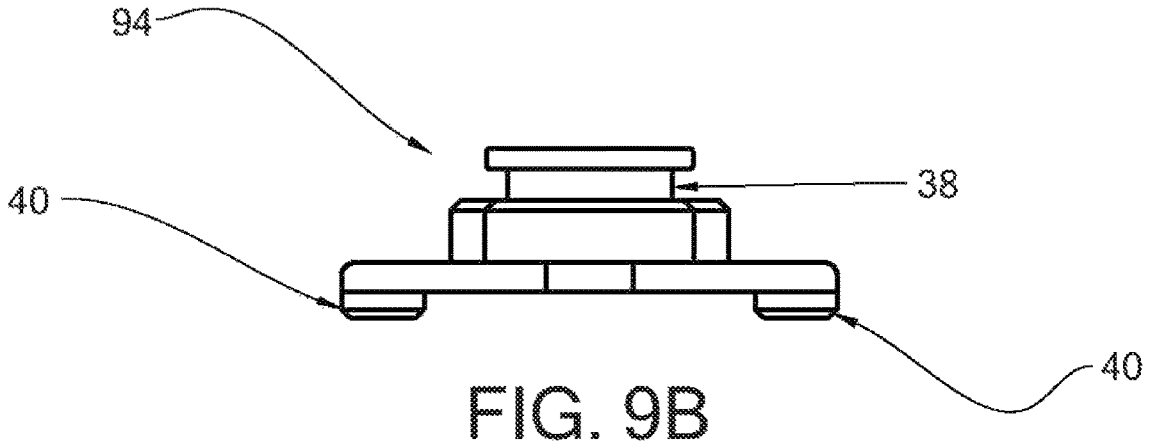
FIG. 9B illustrates a side view of the post of the modular linking system of FIG. 1, showing the locking post and slide lockup channel.
Figure 10:
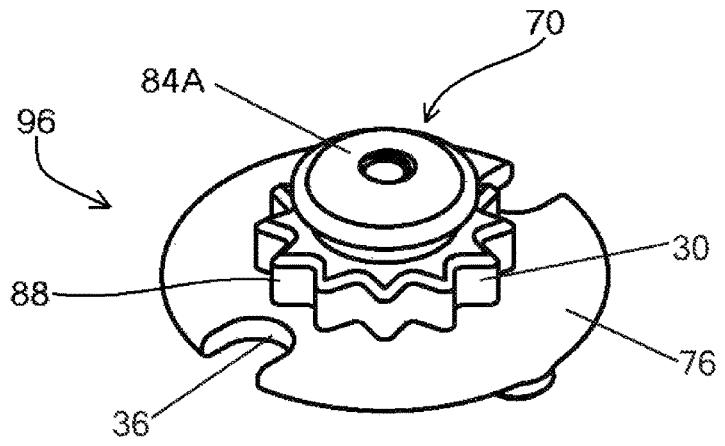
FIG. 10 illustrates a perspective view of a post assembly of the modular linking system of FIG. 2.
Figure 11:
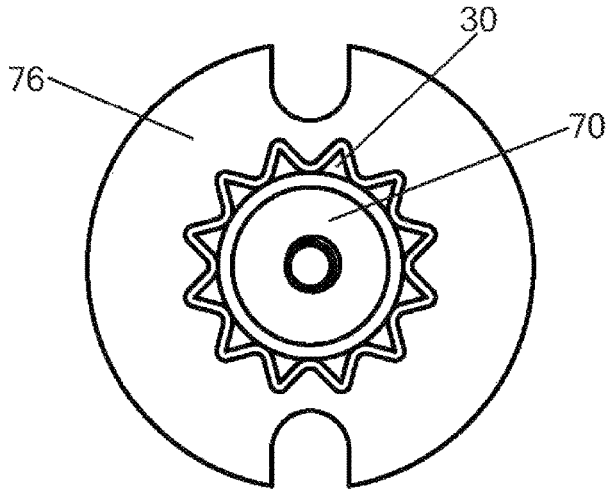
FIG. 11 illustrates a front view of the post assembly of FIG. 10.

One embodiment of the post assembly 94 is seen in FIGS. 9A and 9B. The gear 30 can include various teeth 88. While twelve teeth 88 are shown in FIG. 9A, this number may vary and may match with the number of teeth 74 in the gear receiver 20 of the base 16 (see FIG. 4). A post mounting hole 32, formed in the end of the rivet nut 84, can allow the post assembly 94 to be affixed to another object by way of screws, wire, cordage, or other similar mounting hardware. The post base 34 can create a stop for when the post assembly 94 and the receiver assembly 92 are interfaced. The post base 34 would not be required if the post assembly 94 is integrated into an object.

The locking slot 36 allows additional mounting options for the post assembly 94. The locking posts 40 can fit into the locking slot 36 allowing two post assemblies 94 to be linked together back-to-back by way of using a screw and nut. The locking post 40 can limit rotation of the post assembly 94 by fitting into holes or slots on anything that the post assembly 94 is affixed. The slide lockup channel 38 can receive the slide 14 when the post assembly 94 is inserted into the gear receiver 20 on the base 16. The gear 30 and the gear receiver 20 allows the post assembly 94 to be affixed to the receiver assembly 92 and set at any preferred angle.

Figure 13:
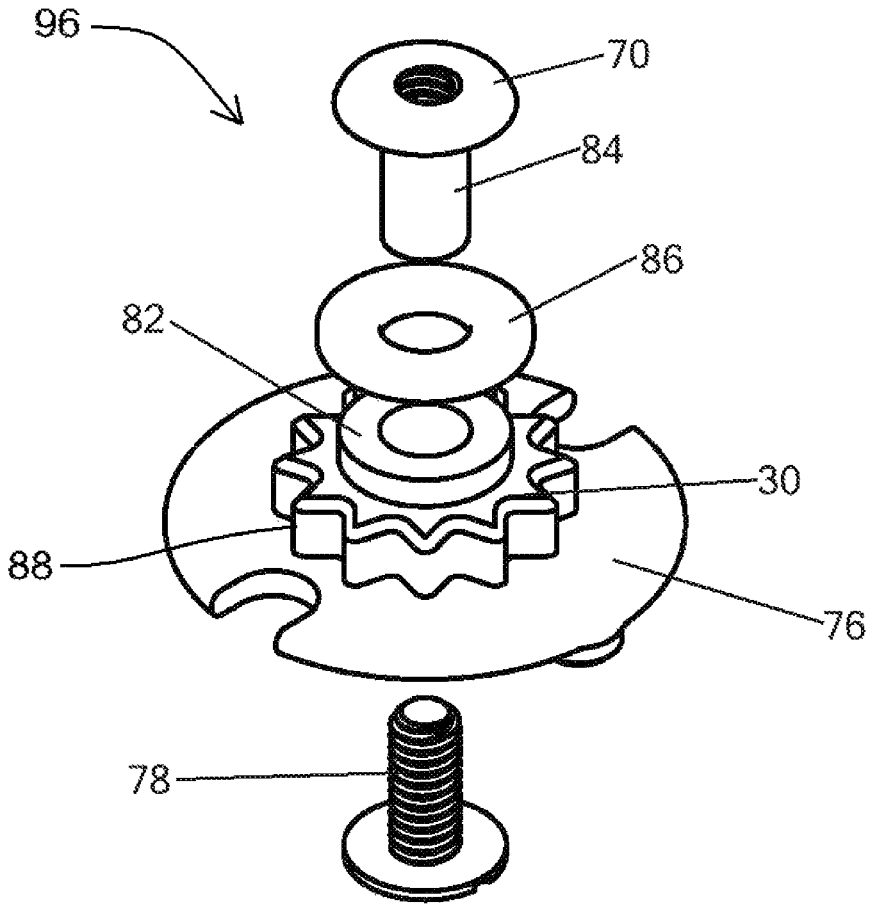
FIG. 13 illustrates an exploded perspective view of the post assembly of FIG. 10.
Figure 14:
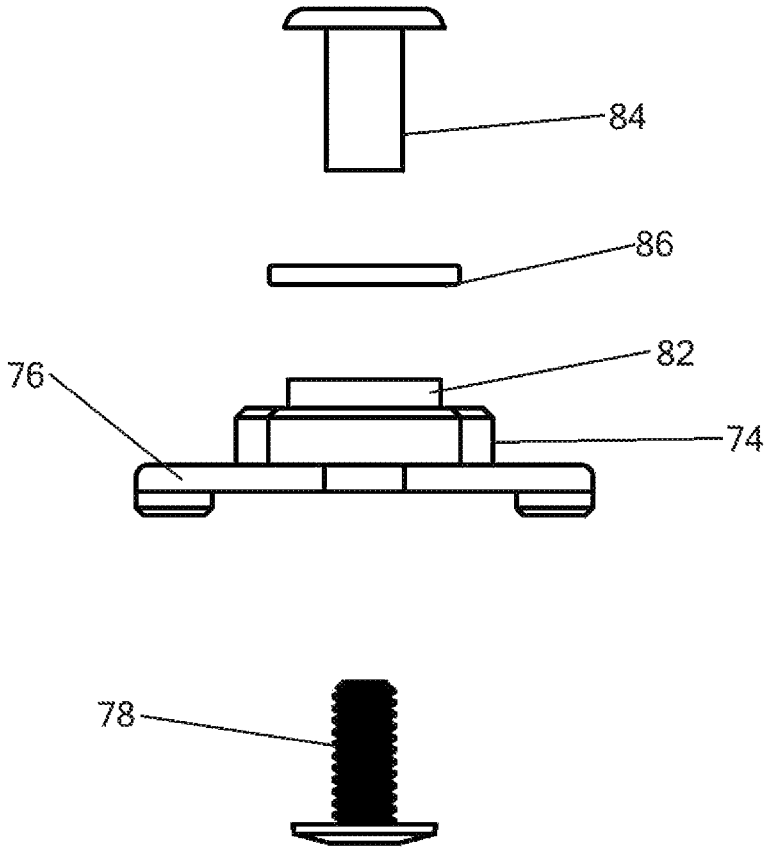
FIG. 14 illustrates an exploded side view of the post assembly of FIG. 10.
Figure 15:
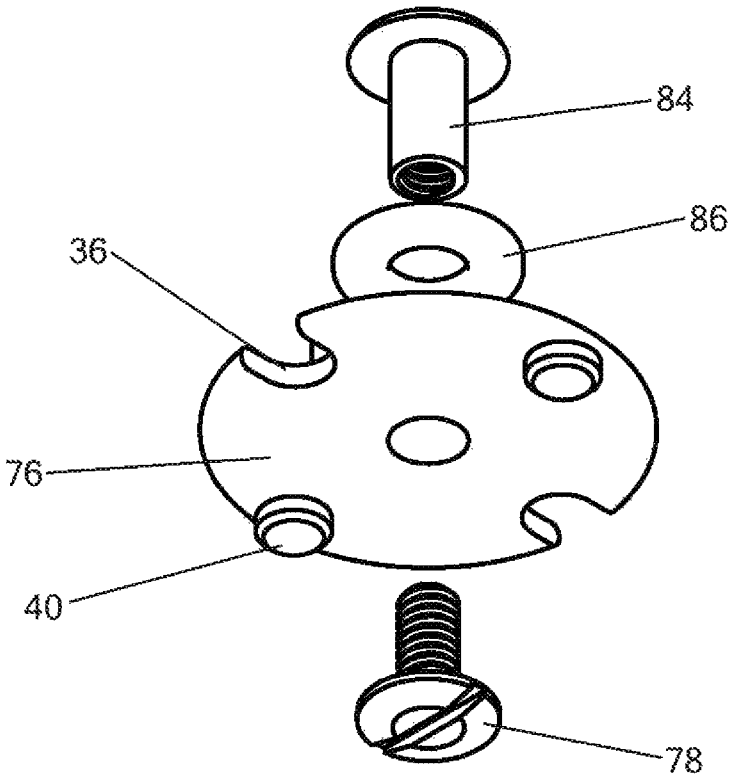
FIG. 15 illustrates an exploded bottom view of the post assembly of FIG. 10.
Figure 16:
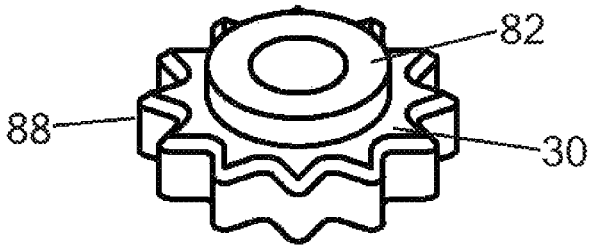
FIG. 16 illustrates a perspective view of the gear of the post assembly of FIG. 10.

Another embodiment of the post assembly 96 is shown in FIGS. 10 through 16. In this embodiment, as best seen in FIGS. 13 through 15, the post assembly 96 can be formed from a screw 78 insertable through a central hole 80 in the back member 76 and the gear 30. The gear 30 can include an extension 82 that has a diameter smaller than the gear teeth 88. The extension 82 defines the width of the lockup channel 72 when the post assembly 96 is assembled. The screw 78 can engage with a flanged rivet nut 84 and a washer 86 can be disposed between the flanged end 84A of the flanged rivet nut 84 and the extension 82, where the lockup channel 72 is formed between the washer 86 and the gear teeth 88. In some embodiments, the washer 86 may not be utilized and the lockup channel 72 may be formed between the flanged end 84A of the flanged rivet nut 84 and the gear 30.

The post assembly 96 may be used without the back member 76, where the screw 78 may be used to secure the gear onto an item, such as a bag, belt, or the like.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A modular locking system comprising:

a receiver assembly including:

a base;

a cover fitting on one side of the base;

a post hole formed in the base, the post hole configured to receive a portion of a post assembly therein, the post hole formed with a plurality of female teeth defining an outer periphery thereof;

a space formed between the base and cover; and a slide fitting in the space, the slide moveable between a locked position, where a locking surface of the slide interacts with the post assembly to retain the post assembly to the receiver assembly, and an unlocked position, where the locking surface is moved out of interaction with the post assembly, wherein the locking surface has an arc that interacts, along at least a portion thereof, with the post assembly in the locked position;

the slide is fully inserted in the space in the locked position and the slide is partially withdrawn from the space in the unlocked position; and the slide is resiliently urged in the fully inserted locked position; and a post assembly, the post assembly including:

a gear having a plurality of gear teeth, the gear teeth mating with the female teeth of the receiver assembly when the gear is inserted in the post hole; and a lockup channel formed between the gear and a distal side of the post assembly, the base of the lockup channel aligning with the arc of the locking surface.

2. The modular locking system of claim 1, wherein the cover includes a cover post hole aligning with the post hole of the base, the cover post hole formed without teeth therein.

3. The modular locking system of claim 1, wherein at least a portion of the arc of the locking surface aligns with the base of the lockup channel.

4. The modular locking system of claim 1, wherein the post assembly includes:

a back member having its distal side disposed on a proximal side of the gear;

one or more locking slots formed in the back member; and one or more locking posts extending from a proximal side of the back member, the one or more locking posts of one post assembly aligning with the one or more locking slots on another one of the post assemblies.

5. The modular locking system of claim 1, wherein the post assembly further includes:

a central hole through the gear;

a back member disposed on a proximal side of the gear, the back member having a back member central hole aligning with the central hole of the gear;

an extension extending from the distal side of the gear, the extension extending a length of the central hole of the gear by a predetermined length, the extension defining the base of the lockup channel, the predetermined length defining a width of the lockup channel;

a nut disposed adjacent the extension;

a screw inserted through the back member central hole and the central hole of the gear to mate with the nut, the lockup channel defined between the gear and the nut.

6. The modular locking system of claim 5, wherein the post assembly further includes a washer disposed between the extension and the nut, the lockup channel defined between the gear and the washer.

7. The modular locking system of claim 5, wherein the nut is a flanged rivet nut extending through the central hole of the gear.

8. The modular locking system of claim 5, wherein the gear is formed integral, as a single component, with the extension.

9. The modular locking system of claim 1, further comprising a spring configured to retain the slide in the locked position, the spring resiliently deformable to permit movement of the slide to the unlocked position.

10. The modular locking system of claim 9, wherein the spring includes two compression springs disposed in spring retention channels of the base while interacting with spring interfaces at opposite sides of the slide.

11. A modular locking system comprising:

a receiver assembly including:

a base;

a cover fitting on one side of the base;

a post hole formed in the base, the post hole having a plurality of female teeth defining an exterior surface of the post hole;

a space formed between the base and cover;

a slide fitting in the space, the slide moveable between a locked position, where a locking surface of the slide interacts to a post assembly to retain the post assembly to the receiver assembly, and an unlocked position, where the locking surface is moved out of interaction with the post assembly; and a lanyard hole formed in an end of the slide, the lanyard hole permitting a user to remotely move the slide into the unlocked position, wherein the locking surface has an arc that interacts, along at least a portion thereof, with the post assembly in the locked position; and the post assembly including:

a gear having a plurality of teeth aligning with the plurality of female teeth of the post hole of the base; and a lockup channel formed between the gear and a distal side of the post assembly, the base of the lockup channel aligning with the arc of the locking surface, wherein the cover includes a cover post hole aligning with the post hole of the base, the cover post hole formed without teeth therein.

12. The modular locking system of claim 11, wherein the post assembly further includes:

a central hole through the gear;

a back member disposed on a proximal side of the gear, the back member having a back member central hole aligning with the central hole of the gear;

an extension extending from the distal side of the gear, the extension extending a length of the central hole through the gear by a predetermined length, the extension defining the base of the lockup channel, the predetermined length defining a width of the lockup channel;

a nut disposed adjacent the extension;

a screw inserted through the back member central hole and the central hole of the gear to mate with the nut, the lockup channel defined between the gear and the nut.

13. The modular locking system of claim 12, wherein the post assembly further includes a washer disposed between the extension and the nut, the lockup channel defined between the gear and the washer.

14. The modular locking system of claim 11, further comprising a spring configured to retain the slide in the locked position, the spring resiliently deformable to permit movement of the slide to the unlocked position.

15. The modular locking system of claim 14, wherein the spring includes two compression springs disposed in spring retention channels of the base while interacting with spring interfaces at opposite sides of the slide.

16. A modular locking system comprising:

a receiver assembly including:

a base;

a cover fitting on one side of the base;

a post hole formed in the base, the post hole having a plurality of female teeth defining an exterior surface of the post hole;

a space formed between the base and cover; and a slide fitting in the space, the slide moveable between a locked position, where a locking surface of the slide interacts to a post assembly to retain the post assembly to the receiver assembly, and an unlocked position, where the locking surface is moved out of interaction with the post assembly;

the post assembly including:

a gear having a plurality of teeth aligning with the plurality of female teeth of the post hole of the base;

a lockup channel formed between the gear and a distal side of the post assembly, the base of the lockup channel aligning with an arc of the locking surface;

a central hole through the gear;

a back member disposed on a proximal side of the gear, the back member having a back member central hole aligning with the central hole of the gear;

an extension extending from the distal side of the gear, the extension extending a length of the central hole through the gear by a predetermined length, the extension defining the base of the lockup channel, the predetermined length defining a width of the lockup channel;

a nut disposed adjacent the extension; and a screw inserted through the back member central hole and the central hole of the gear to mate with the nut, the lockup channel defined between the gear and the nut; and a spring configured to retain the slide in the locked position, the spring resiliently deformable to permit movement of the slide to the unlocked position, the spring disposed in a spring retention channel of the base while interacting with a spring interface of the slide, wherein the cover includes a cover post hole aligning with the post hole of the base, the cover post hole formed without teeth therein.

17. The modular locking system of claim 16, wherein the post assembly further includes a washer disposed between the extension and the nut, the lockup channel defined between the gear and the washer.

18. The modular locking system of claim 16, wherein the post assembly includes:

the back member having its distal side disposed on a proximal side of the gear;

one or more locking slots formed in the back member; and one or more locking posts extending from a proximal side of the back member, the one or more locking posts of one post assembly aligning with the one or more locking slots on another one of the post assemblies.

* * * * *